US005301507A

United States Patent [19]

Laskaris et al.

[11] Patent Number: 5,301,507

[45] Date of Patent: Apr. 12, 1994

[54] SUPERCONDUCTING MAGNETIC ENERGY STORAGE DEVICE

[75] Inventors: Evangelos T. Laskaris, Schenectady; Ahmed K. Kalafala, Albany, both of N.Y.

[73] Assignee: General Electric Company, Schenectady, N.Y.

[21] Appl. No.: 923,683

[22] Filed: Aug. 3, 1992

[51] Int. Cl.[5] ..... F25B 19/00; H01F 7/22

[52] U.S. Cl. ..... 62/51.1; 62/295; 165/185; 505/892; 505/894

[58] Field of Search ..... 62/6, 51.1, 295; 505/892, 894; 174/15.4; 335/216, 299, 300; 323/360; 363/14; 165/185

[56] References Cited

U.S. PATENT DOCUMENTS

| | | | |
|---|---|---|---|
| 4,876,413 | 10/1989 | Vermilyea | 174/15.4 |
| 4,926,647 | 5/1990 | Dorri et al. | 174/15.4 X |
| 4,930,318 | 6/1990 | Brzozowski | 505/892 X |
| 4,986,078 | 1/1991 | Laskaris | 505/892 X |
| 5,032,869 | 7/1991 | Herd et al. | 62/51.1 X |
| 5,034,713 | 7/1991 | Herd et al. | 62/51.1 X |
| 5,045,826 | 9/1991 | Laskaris | 174/15.4 X |
| 5,083,105 | 1/1992 | Herd et al. | 174/15.4 X |
| 5,111,665 | 5/1992 | Ackermann | 62/51.1 X |
| 5,113,165 | 5/1992 | Ackermann | 335/300 X |
| 5,129,232 | 7/1992 | Minas et al. | 505/892 X |

*Primary Examiner*—Henry A. Bennet
*Assistant Examiner*—Christopher B. Kilner
*Attorney, Agent, or Firm*—Paul R. Webb, II

[57] ABSTRACT

This invention relates to a cryogenless superconducting magnet system of the type that is attached to a utility grid at end-user site and is used to store electrical energy until such time that an electrical disruption occurs in the grid. Structures of this type, generally, allow the stored electrical energy to be released in such a manner that the disruption in the utility grid is negated before it reaches critical loads.

8 Claims, 6 Drawing Sheets

156
152
250
258
256
7
254
262
252
260
166
266
258
276
264
274
24
6
272
268
7
6
152

SUPERCONDUCTING MAGNETIC ENERGY STORAGE DEVICE

BACKGROUND OF THE INVENTION

1. Field of the Invention

This invention relates to a cryogenless superconducting magnet system of the type that is attached to a utility grid at end-user site and is used to store electrical energy until such time that an electrical disruption occurs in the grid. Structures of this type, generally, allow the stored electrical energy to be released in such a manner that the disruption in the utility grid is negated before it reaches critical loads.

2. Description of the Related Art

Today, low power electronic systems are being used increasingly as controllers for much larger mechanical-/electrical machinery. A wide variety of industries across the country are finding that these automated electronic equipment—including adjustable-speed drives, programmable logic controllers and power supplies in computers—are vulnerable to overvoltage, undervoltage, momentary interruptions and other disturbances that have always existed in the utility power line. Much of this advanced equipment also generates disturbances back onto the utility line. Therefore, a more advantageous system, then, would be presented if such amounts of these various electrical disturbances were reduced.

It is apparent from the above that there exists a need in the art for a superconducting magnet which is capable of negating various electrical disruptions before they reach critical load, and which at the same time at least equals the superconducting characteristics of known superconducting magnets. It is a purpose of this invention to fulfill this and other needs in the art in a manner more apparent to the skilled artisan once given the following disclosure.

SUMMARY OF THE INVENTION

Generally speaking, this invention fulfills these needs by providing a cryogenless superconducting magnetic energy storage device comprising a superconductive winding means, a cryostat means substantially located around said winding means, a suspension means which is operatively connected to said winding means and said cryostat means, a vacuum containment means substantially located around said winding means, said cryostat means and said suspension means, and a refrigeration means operatively connected to said winding means and said cryostat means.

In certain preferred embodiments, the superconducting winding means includes a low temperature superconductor constructed of a niobium-tin superconductor with a sintered copper stabilizer that is layered with glass cloth and an array of axial metal foil straps of insulated copper wires, expanded metal or perforated metal foil. Also, the cryostat contains a thermal shield and a retractable sleeve. Also, the suspension means includes a bumper, a winding suspension bracket, a shield suspension bracket, and suspension rods. Finally, the refrigeration means is Gifford-McMahon cryocooler.

In another preferred embodiment the superconducting winding means includes a high temperature superconductor, such as silver-sheathed BiPbSrCaCuO tape.

In another further preferred embodiment, substantially all of the electrical disruptions experienced by the cryogenless superconducting magnetic energy storage device are negated before the storage device reaches critical loads.

The preferred cryogenless superconducting magnetic energy storage device, according to this invention, offers the following advantages: ease of assembly and repair; excellent superconducting characteristics; good stability; good durability; excellent electrical disruption negation; good economy; and high strength for safety. In fact, in many of the preferred embodiments, these factors of superconducting characteristics and electrical disruption negation are optimized to an extent that is considerably higher than heretofore achieved in prior, known superconducting magnets.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several veins and in which.

DETAILED DESCRIPTION OF THE INVENTION

Figure 1:
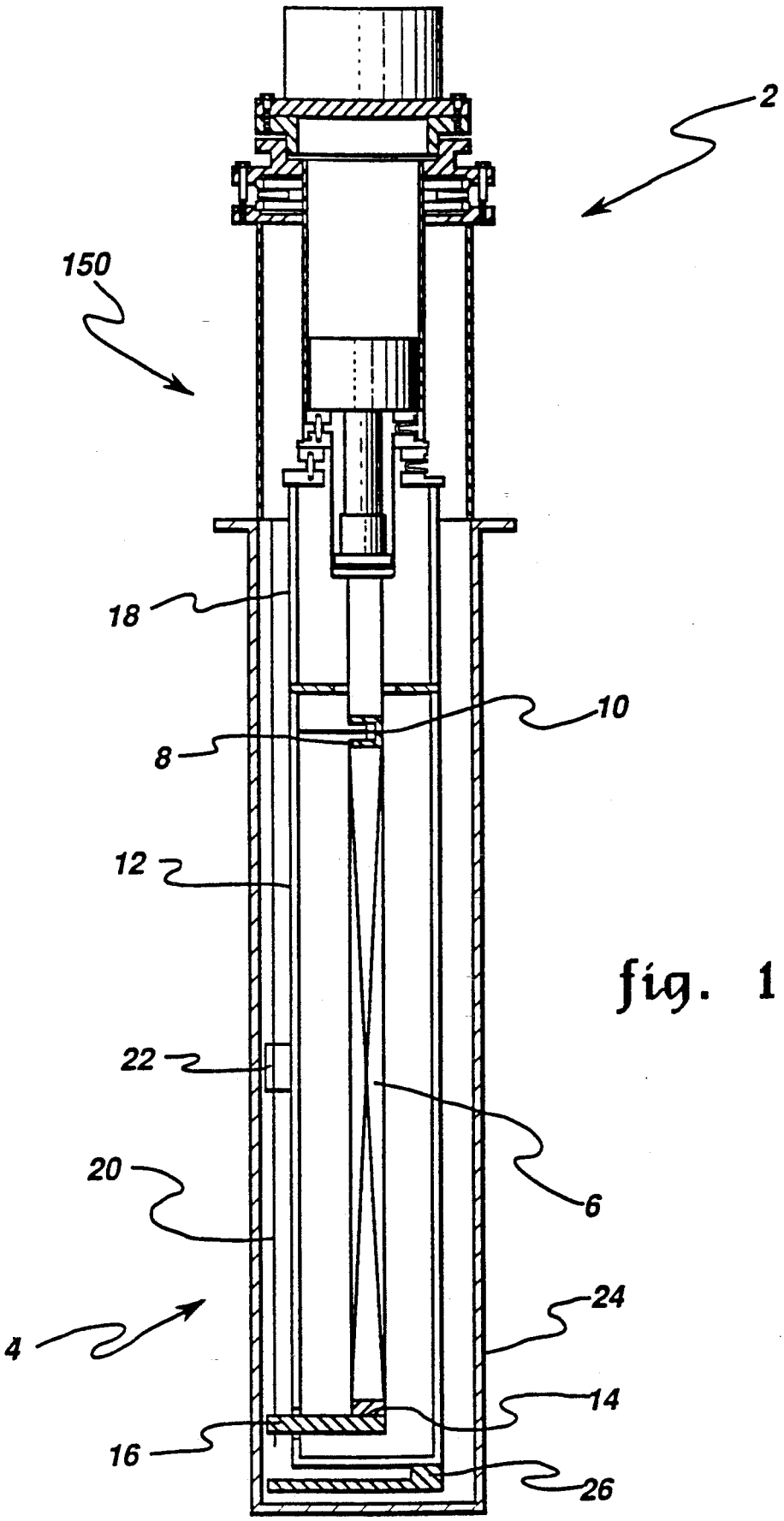
FIG. 1 is a side plan view of a cryogenless superconducting magnetic energy storage device, according to the present invention.

With reference first to FIG. 1, there is illustrated cryogenless superconducting magnetic energy storage device (SMES) 2. SMES 2 includes, in part, winding suspension 4 and refrigeration assembly 150. In particular, winding suspension 4 includes epoxy-impregnated winding 6, bracket 8, bumper 10, thermal shield 12, bracket extension 14, winding suspension bracket 16, heat station 18, suspension rods 20, shield suspension 22, vacuum envelope 24, and bumper 26.

With respect to winding 6, the construction of winding 6 will be described in detail later. Winding 6 is rigidly attached to bracket 8 and extension 14 by conventional epoxy-impregnation (not shown). Bracket 8, extension 14, and bumper 10, preferably are constructed of fiberglass. Thermal shield 12 which, preferably, is constructed of aluminum, is rigidly attached to thermal station 18 by a conventional bolted joint (not shown). Winding suspension bracket 16 which, preferably, is constructed of NMSS is rigidly attached to extension 14 by a conventional bolts (not shown). Bracket 16 is also rigidly attached to suspension rod 20 by conventional bolts (not shown). Rods 20, preferably, are constructed of fiberglass. Rods 20 are rigidly attached to shield suspension bracket 22 by a conventional bolts (not shown). Bracket 22, preferably, is constructed of aluminum. Bracket 22 is rigidly attached to thermal shield 12 by a conventional weldment (not shown). Vacuum envelope 24 which, preferably, is constructed of any suitable stainless steel, is rigidly attached to refrigeration assembly 150 by a conventional weldment (not shown). Bumper 26, preferably, is constructed of fiberglass and is rigidly attached to thermal shield 12 by a conventional bolts (not shown).

Figures 2, 3:
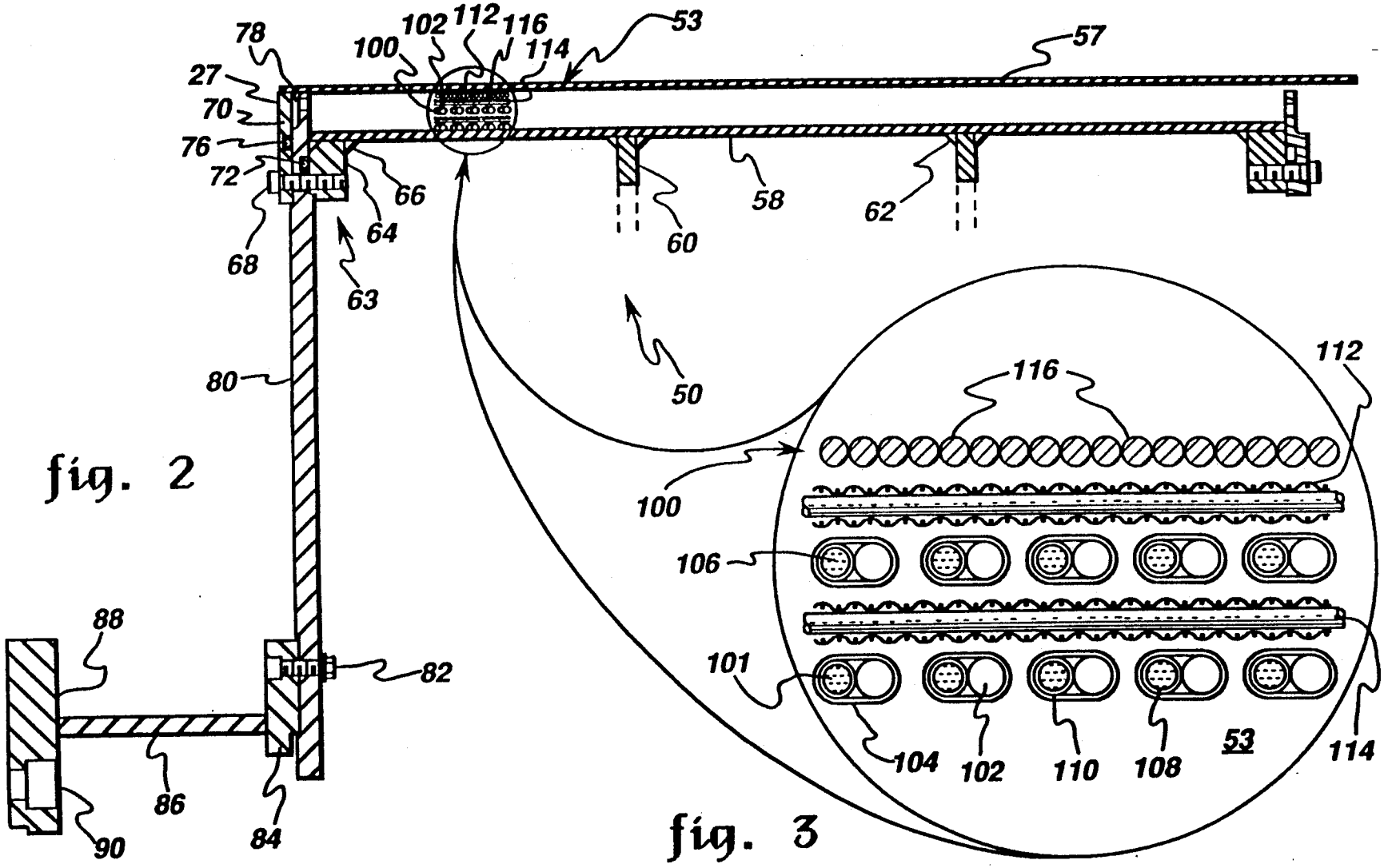
FIG. 2 is a side plan view of a superconducting winding and support for the cryogenless superconducting magnetic energy storage device, according to the present invention.
FIG. 3 is a detailed view of the superconducting winding of FIG. 2.

With reference to FIG. 2, there is illustrated superconductive winding and demountable coil form 50. Winding and demountable coil form 50 includes, in part, superconductive winding 53, impregnation pan 57, mandrel 58, mandrel support 63, epoxy inlet holes 78, support legs 80, 86, and bracket 88.

Mandrel 58, preferably, is constructed of any suitable metallic material. Supports 60 which, preferably, are constructed of any suitable metallic material are welded by conventional weldments 62 to mandrel 58. Located on mandrel 58 is superconductive winding 53. Superconductive winding 53 will be discussed in more detail later with reference to FIG. 3. A conventional impregnation pan 57 is located on top of superconductive winding 53.

Mandrel 58 is rigidly attached to bracket 80 by mandrel support 63. In particular, mandrel support 63 includes conventional bracket 64 which is rigidly attached to mandrel 58 by conventional weldment 66. Conventional fastener 68 is used to attach conventional brackets 80 and 70 to bracket 64. Conventional elastomeric O-rings 72 and 76 are used to prevent epoxy from leaking out around mandrel support 63. Located on bracket 80 is epoxy inlet hole 78. Hole 78 allows epoxy to be introduced into the area between mandrel 58 and impregnation pan 57 so that superconductive winding 53 will be impregnated with epoxy.

Connected to the other end of bracket 80 is a conventional bracket 84. Bracket 84 is rigidly attached to bracket 80 by conventional fastener 82. A conventional bracket 86 is rigidly attached to brackets 84, 88 by a conventional attachment (not shown). Located within bracket 88 is a fastener hole 90 which is used to attach bracket 88 to a conventional support stand (not shown).

With respect to FIGS. 2 and 3, there is shown a detailed illustration of superconductive winding 53. In particular, winding 53 includes superconductor wire 100, insulation cloth 112, and an array 114 of foil straps of insulated copper wires, expanded metal or perforated foil. Insulation cloth 112, preferably is constructed of glass cloth. Straps 114, preferably, are constructed of insulated copper wires or copper foils straps of expanded metal or perforated foil. As shown more clearly in FIG. 3, wire 100 includes matrix 101, filaments 106, diffusion barrier 108 and stabilizer ring 110. In particular, matrix 101, preferably, is constructed of bronze. Filaments 106, preferably, are constructed of niobium. Diffusion barrier 108 is located around the circumference of matrix 101 in order to prevent tin from diffusing into ring 110. Diffusion barrier 108, preferably, is constructed of niobium. Ring 110 and stabilizer wire 102, preferably, are constructed of copper. Insulation 104, preferably, is constructed of filamentary glass.

In order to construct composite superconducting wire 53, superconductor wire 100 is paired with wire 102. It is to be understood that wire 100 and wire 102 should be approximately the same diameter. After wire 100 is paired with wire 102, both wires 100 and 102 are insulated with a spiral wrap of insulation 104 by conventional wrapping techniques. Insulation 104, preferably, is wrapped under tension so that wires 100 and 102 are in good contact with each other. The insulated pairs of wires 100 and 102 is wound onto a conventional stainless steel reaction spool (not shown) by conventional winding techniques. The wound spool is placed inside a conventional vacuum furnace (not shown) and is subjected to a conventional temperature/time schedule which is designed to react the niobium with the tin in order to form $Nb_3Sn$. At the reaction temperatures which, typically, are at least 600° C., the thermal expansions of wires 100 and 102 exceed that of insulation 104 so that wires 100 and 102 are forced into tighter contact with each other. The conventional vacuum atmosphere, high temperature at high contact pressure causes wires 100 and 102 to sinter with each other. As a result, copper wire 102 is in intimate contact with the superconductor wire 100 in order to share current and provide additional stabilization in the event that the superconductor transitions to the normal state.

After superconductor wire 100 has been formed, superconductive winding 53 is formed by wrapping superconductor wire 100 around mandrel 58 by conventional wrapping techniques. A layer of insulation 112 is then wound on top of superconducting wire 100 by conventional wrapping techniques. Finally, an array 114 of insulated copper wires are wrapped around the insulation layer 112. This wrapping procedure is then repeated such that there is at least one layer of insulation between superconducting wire 100 and array 114. After superconducting winding 53 has been wound around mandrel 58, several layers of stainless steel wire 116 are wound around by conventional winding techniques on the outside surface of winding 53 to provide a rigid structure for supporting the radial electromagnetic loads.

After superconducting winding 53 and stainless steel overwrap 116 has been wrapped around mandrel 58, impregnation pan 57 is placed over top of superconductive winding 53. Once impregnation pan 57 is in place, a conventional epoxy is transported by a conventional epoxy transportation means (not shown) through hole 78 in bracket 74. Winding 53 is then epoxy impregnated by conventional techniques and released from mandrel 58 to form a self-supported structurally robust composite with high thermal conductivity which is capable of withstanding the hoop and axial stresses that result from the electromagnetic load created by the superconducting magnet, as well as, the thermal strains that result from the normal transition of the superconductor.

Figure 4:
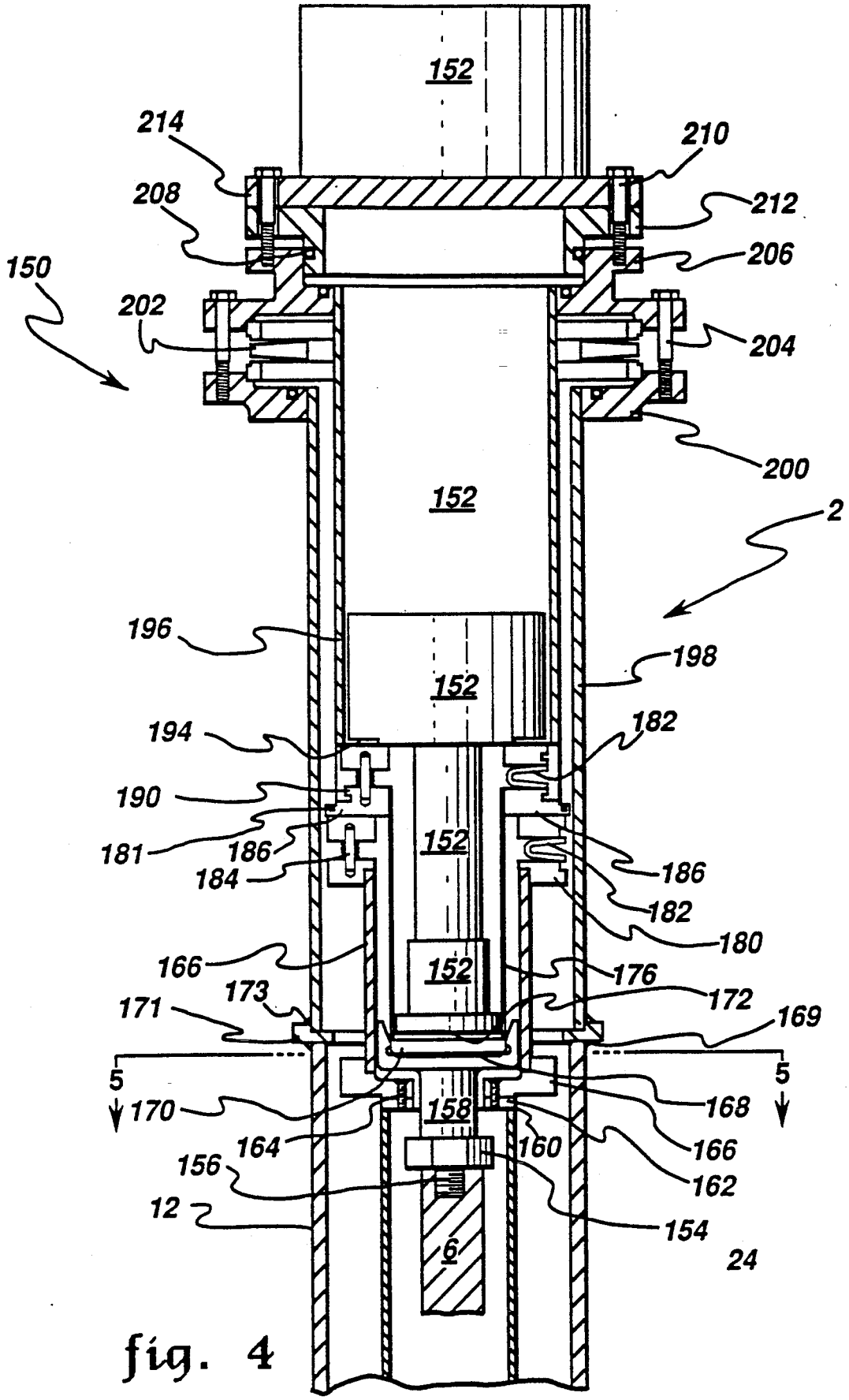
FIG. 4 is a side plan view of the refrigeration system for the cryogenless superconducting magnetic energy storage device, according to the present invention.

FIG. 4 illustrates refrigeration assembly 150. Assembly 150 includes, in part, a conventional Gifford-McMahon cryocooler 152, thermal shield 12, thermal stations 166 and 158, flexible straps 182, belleville springs 184, bellows 202, and bolts 204 and 210. In particular, superconductive winding 6 is rigidly attached to segmented ring 154 by conventional fastener 156 and thermal extension 158. Ring 154 and extension 158, preferably, are constructed of copper. Thermal shield 12 is rigidly attached to plate 162 by conventional weldment 160. Plate 162, preferably, is constructed of aluminum. Plate 162 is rigidly attached to thermal station 166 by conventional fasteners 164. Thermal station 166, preferably, is constructed of copper. Thermal contacts 168 thermally connect extension 158 and thermal contact extension 170. Thermal contact 168, preferably, is constructed of serrated copper on cast indium. Thermal contact extension 170, preferably, is constructed of copper. Located between thermal contact extension 170 and cryocooler 152 is cryocooler contact 172. Contact 172, preferably, is constructed of an indium gasket.

Located around cryocooler 152 is vacuum envelope 198. Envelope 198, preferably, is constructed of steel and is rigidly attached to extension 171 by a conventional weldment 173. Extension 171 which, preferably, is constructed of stainless steel and is rigidly attached to vacuum envelope 24 by a conventional weldment 169. Located adjacent to thermal station 166 is thermal busbar 176. Thermal busbar 176, preferably, is constructed of stainless steel. Thermal busbar 176 is rigidly attached to contact extension 170 and bracket 186 by conventional braze joints (not shown). Thermal station 166 is rigidly attached to bracket 180 by conventional braze joints (not shown).

Bracket 180 which, preferably, is constructed of copper, houses flexible straps 182. Straps 182, preferably, are constructed of any suitable flexible copper laminate. Bracket 180, which, preferably, is constructed of copper houses a conventional belleville spring assembly 184. Located between brackets 180 and 190 is cryocooler contact 186. Contact 186, preferably, is constructed of an indium gasket. Bracket 190 is joined to sleeve 196 by conventional braze. Cryocooler contact 194, which, preferably is constructed of an indium gasket is located above bracket 190.

Retractable sleeve 196 is rigidly attached to bracket 190 by conventional braze joints (not shown). Sleeve 196, preferably, is constructed of NMSS. The upper end of sleeve 196 is rigidly attached to bracket 206 by a conventional weldment (not shown). Vacuum envelope 198 is rigidly attached to bracket 200 by a conventional weldment (not shown). Located between bracket 206 and 200 is a conventional bellows assembly 202 and fastener 204. Brackets 200 and 206, preferably, are constructed of NMSS. Located above bracket 206 is bracket 212 and plate 214. Bracket 212 and plate 214, preferably, are constructed of NMSS. Plate 214 is rigidly attached to bracket 212 by a conventional fastener 210. Located between bracket 206 and bracket 212 is a conventional elastomeric O-ring 208.

During the operation of refrigeration assembly 150, as superconductive winding 6 is energized during the operation of magnet 2, heat is created in superconductive winding 6. In particular, as this heat is created in winding 6, the heat is traversed through thermal station 166 and thermal extension 158 back to cryocooler 152 where the heat is dissipated. In order to activate thermal contacts 168 and 186, fastener 204 is rotated such that bracket 190 contacts bracket 180. In order to activate cryocooler contacts 172 and 194, fastener 210 is rotated such that cryocooler 152 contacts thermal extension 170. This rotation of fastener 210 also causes cryocooler 152 to contact bracket 190.

Figure 5:
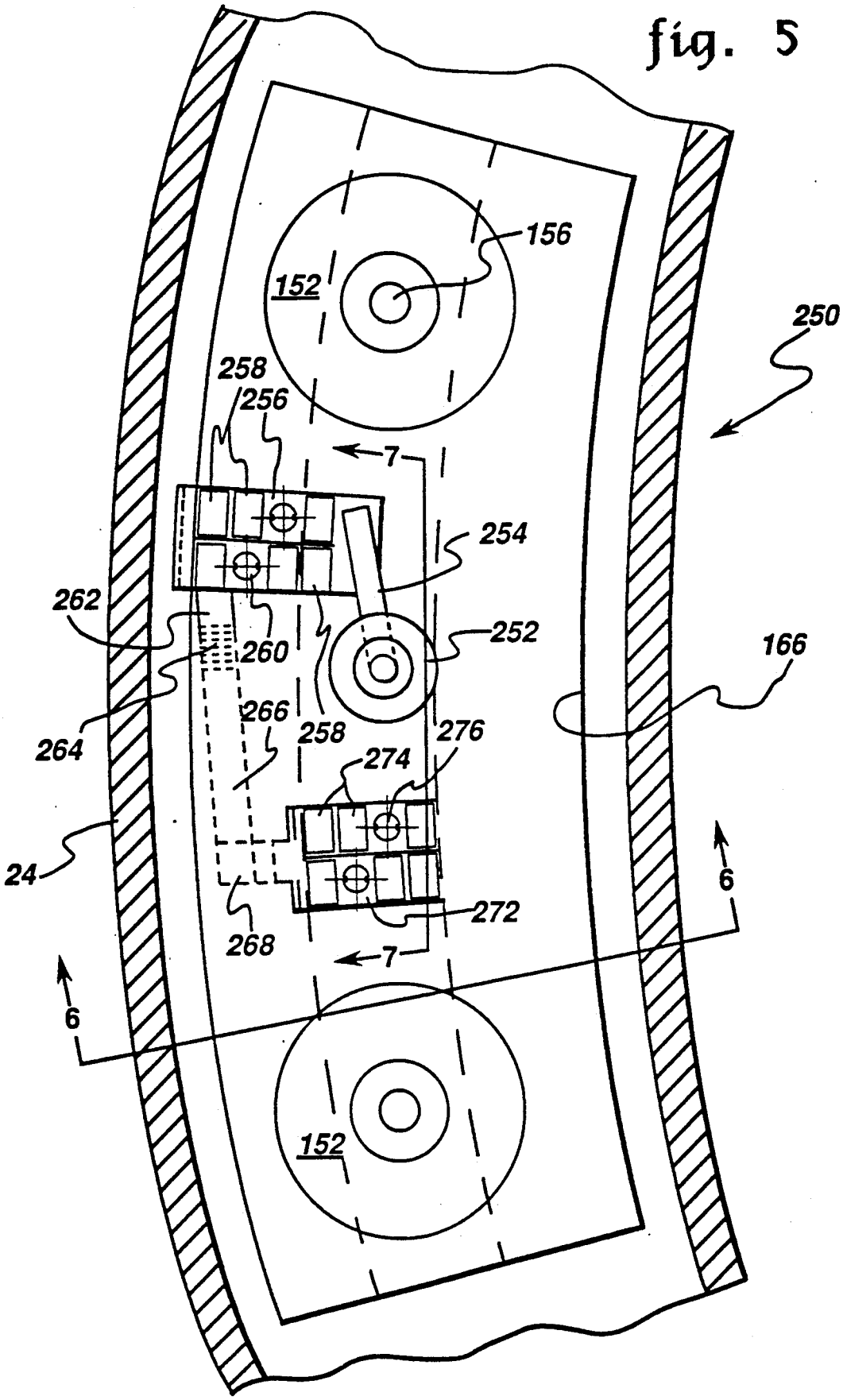
FIG. 5 is a top view of the superconducting current lead assembly, take along lines 5—5 of FIG. 4, according to the present invention.
Figure 6:
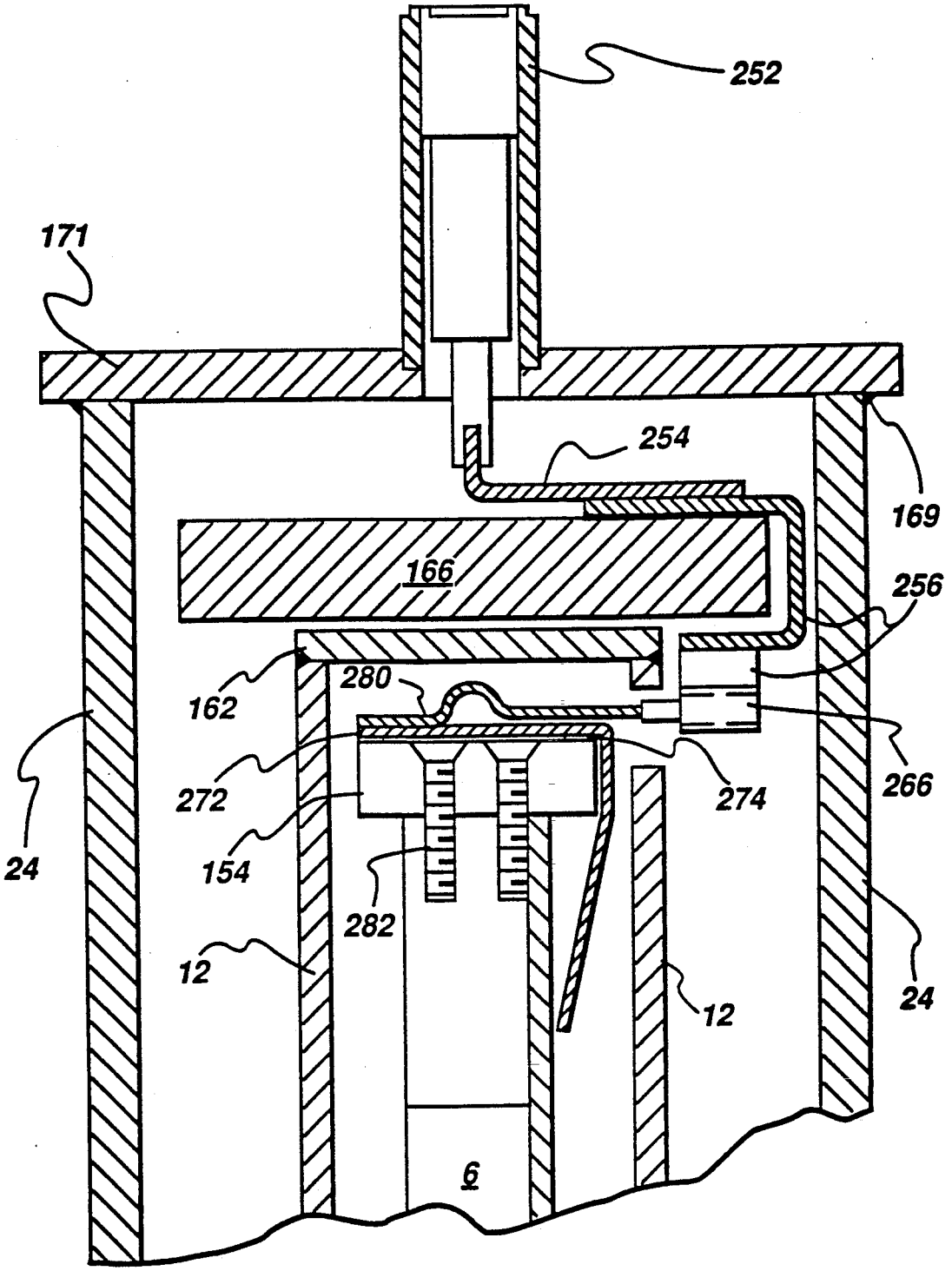
FIG. 6 is a end view of the superconducting current lead assembly taken along lines 6—6 of FIG. 5.
Figure 7:
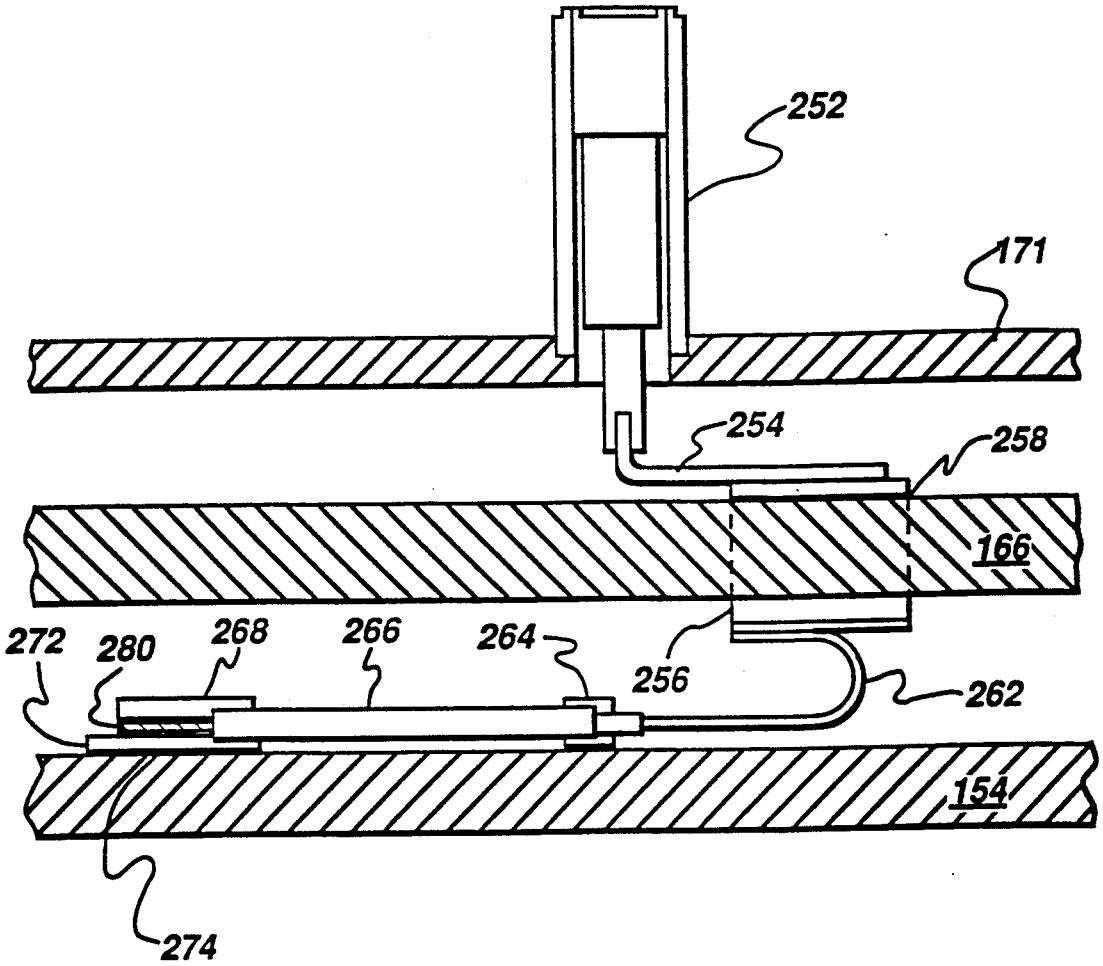
FIG. 7 is a side view of the superconducting lead assembly, taken along line 7—7 of FIG. 5.

FIG. 5 shows current lead assembly 250. In particular, lead assembly 250 includes, in part, a conventional current lead output port 252, first stage lead 254, lead extension 256, second stage lead 266 (FIG. 6), second stage contact 272, vacuum envelope 24, thermal shield 12 and heat station 166. In particular, as shown with respect to FIGS. 5 and 6, port 252 is rigidly attached to plate 171 by a conventional fastener (not shown). Port 252 is thermally and electrically connected to first stage lead 254. Lead 254, preferably, is constructed of copper. Lead 254 is rigidly attached to thermal extension 256 by a conventional soldered joint (not shown). Located between thermal station 166 and thermal extension 256 are thermal contacts 258. Contacts 258, preferably, are constructed of metallized beryllia or alumina ceramic. These thermal contacts 258 allow heat to transfer from thermal station 166 to lead 254.

Located below thermal extension 256 is thermal busbar 262. Busbar 262 is, preferably, constructed of a flexible copper laminate and is rigidly attached to thermal extension 256 by a conventional soldered joint (not shown). Also, busbar 262 is rigidly attached to superconducting lead extension 264 by a conventional soldered joint (not shown). A superconducting lead 266 is rigidly attached to extension 264. Lead 266 is, preferably, constructed of any suitable high temperature, ceramic superconducting material. The other end of lead 266 is rigidly attached to thermal extension 268 by a conventional soldered joint (not shown).

Extension 268, which, preferably, is constructed of copper is rigidly attached to second stage lead 280 by a conventional solder joint (not shown). Lead 280, preferably, is constructed of a suitable flexible copper laminate. Lead 280 is rigidly attached to thermal extension 272 by a conventional soldered joint (not shown). Extension 272, preferably, is constructed of any suitable flexible copper laminate. Extension 272 is thermally connected to thermal station 154 by thermal contacts 274. Thermal contacts 274 are constructed of the same material as thermal contacts 258. Finally, thermal station 154 is rigidly attached to superconductive winding 6 by conventional fasteners 282.

During the operation of current lead assembly 250, the first stage lead 254 operates from ambient temperature to the temperature at thermal shield 12 and second stage lead 266 operates from the temperature of thermal shield 12 to that of superconducting winding 6. Current leads 254 and 266 are cooled by direct contact to superconducting winding 6 and heat station 166.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A superconducting magnetic energy storage device, said device comprised of:

a superconductive winding;

a cryostat means substantially located around said winding means;

a suspension means which is operatively connected to said winding means and said cryostat means;

a vacuum containment means located substantially around said winding means, said cryostat means and said suspension means; and a refrigeration means operatively connected to said winding means and said cryostat means, wherein said refrigeration means is further comprised of;

a cryocooler means;

a thermal station means which is thermally connected to said superconductive winding and said cryocooler means;

a thermal contact means located substantially between said thermal station means and said cryocooler means;

a refrigeration suspension means operatively connected to said cryocooler means;

a cryocooler contact means located substantially between said refrigeration suspension means and said cryocooler; and a refrigeration suspension adjustment means operatively connected to said refrigeration suspension means, and wherein said refrigeration means is further comprised of: a ring means operatively connected to said superconductive winding.

2. A superconducting magnetic energy storage device, said device comprised of:

a superconductive winding;

a cryostat means substantially located around said winding means;

a suspension means which is operatively connected to said winding means and said cryostat means;

a vacuum containment means located substantially around said winding means, said cryostat means and said suspension means; and a refrigeration means operatively connected to said winding means and said cryostat means, wherein said refrigeration means is further comprised of:

a cryocooler means;

a thermal station means which is thermally connected to said superconductive winding and said cryocooler means;

a thermal contact means located substantially between said thermal station means and said cryocooler means;

a refrigeration suspension means operatively connected to said cryocooler means;

a cryocooler contact means located substantially between said refrigeration suspension means and said cryocooler; and a refrigeration suspension adjustment means operatively connected to said refrigeration suspension means, and wherein said thermal contact means is further comprised of: serrated copper on cast indium.

3. A superconducting magnetic energy storage device, said device comprised of:

a superconductive winding;

a cryostat means substantially located around said winding means;

a suspension means which is operatively connected to said winding means and said cryostat means;

a vacuum containment means located substantially around said winding means, said cryostat means and said suspension means; and a refrigeration means operatively connected to said winding means and said cryostat means, wherein said refrigeration means is further comprised of:

a cryocooler means;

a thermal station means which is thermally connected to said superconductive winding and said cryocooler means;

a thermal contact means located substantially between said thermal station means and said cryocooler means;

a refrigeration suspension means operatively connected to said cryocooler means;

a cryocooler contact means located substantially between said refrigeration suspension means and said cryocooler; and a refrigeration suspension adjustment means operatively connected to said refrigeration suspension means, and wherein said refrigeration suspension means is further comprised of:

a first and second spring means;

a first bracket means operatively connected to said thermal station means and housing said first and second spring means;

a third spring means having two ends; and a second bracket means operatively connected to said cryostat means and one of said two ends of said third spring means, and wherein said first spring means is a belleville spring.

4. The device, according to claim 3, wherein said second spring means is a flexible strap.

5. The device, according to claim 3, wherein said third spring means is a bellows.

6. A superconducting magnetic energy storage device, said device comprised of:

a superconductive winding;

a cryostat means substantially located around said winding means;

a suspension means which is operatively connected to said winding means and said cryostat means;

a vacuum containment means located substantially around said winding means, said cryostat means and said suspension means; and a refrigeration means operatively connected to said winding means and said cryostat means, wherein said refrigeration means is further comprised of:

a cryocooler means;

a thermal station means which is thermally connected to said superconductive winding and said cryocooler means;

a thermal contact means located substantially between said thermal station means and said cryocooler means;

a refrigeration suspension means operatively connected to said cryocooler means;

a cryocooler contact means located substantially between said refrigeration suspension means and said cryocooler; and a refrigeration suspension adjustment means operatively connected to said refrigeration suspension means, and wherein said refrigeration suspension adjustment means is further comprised of:

a thermal contact adjustment means; and a cryocooler contact adjustment means.

7. The device, according to claim 6, wherein said thermal contact adjustment means is further comprised of:

a third bracket means operatively connected to said vacuum containment means; and a fastener means which is threadedly engageable with said third bracket means.

8. The device, according to claim 6, wherein said cryocooler contact adjustment means is further comprised of:

a fourth bracket means operatively connected to said refrigeration means; and a fastener means which is threadedly engageable with said fourth bracket means.

* * * * *